US005254015A

United States Patent [19]

Robertson

[11] Patent Number: 5,254,015

[45] Date of Patent: Oct. 19, 1993

[54] INSULATION DISPLACING BARREL TERMINAL

[75] Inventor: James W. Robertson, Oberlin, Pa.

[73] Assignee: AMP Incorporated, Harrisburg, Pa.

[21] Appl. No.: 773,069

[22] Filed: Oct. 7, 1991

[51] Int. Cl.[5] ..... H01R 4/24

[52] U.S. Cl. ..... 439/410; 439/725

[58] Field of Search ..... 439/395, 402–407, 439/409–413, 417–419, 816

[56] References Cited

U.S. PATENT DOCUMENTS

| | | | |
|---|---|---|---|
| 2,680,145 | 6/1954 | Lanfear | 439/409 |
| 2,908,884 | 8/1955 | Wirsching | 339/99 |
| 2,924,807 | 2/1960 | Field | 439/848 |
| 3,351,889 | 11/1967 | Lawlor et al. | 339/97 |
| 3,734,061 | 3/1988 | Randall, Jr. et al. | 439/709 |
| 3,877,773 | 4/1975 | Doty et al. | 339/97 P |
| 4,157,208 | 6/1979 | Roberts et al. | 339/98 |
| 4,171,861 | 10/1979 | Hohorst | 439/789 |
| 4,186,984 | 2/1980 | Reavis, Jr. et al. | 339/103 R |
| 4,283,105 | 8/1981 | Ferrill et al. | 339/97 R |
| 4,431,247 | 2/1984 | Abdullah et al. | 339/97 P |
| 4,536,049 | 8/1985 | Wilmes | 339/97 R |
| 4,637,675 | 1/1987 | Loose | 339/97 R |
| 4,705,340 | 11/1987 | Loose | 439/395 |
| 4,795,363 | 1/1989 | Scherer et al. | 439/395 |
| 4,795,364 | 1/1989 | Frantum, Jr. | 439/407 |
| 4,929,190 | 5/1990 | Gonon et al. | 439/409 |
| 5,006,077 | 4/1991 | Loose et al. | 439/409 |

*Primary Examiner*—David Pirlot
*Attorney, Agent, or Firm*—Anton P. Ness

[57] ABSTRACT

A one-piece insulation displacing terminal having a first portion, a second portion, and a connecting portion connecting the first and second portions. The connecting portion is torsional in order to permit the first portion to rotate relative to the second portion. In one embodiment, the first portion has adjacent first and second walls which are arcuately shaped and which have wire receiving openings therein. The wire receiving openings have associated wire receiving slots. The second portion is mounted in an insulating housing of a connector assembly on a post having a post opening therethrough which has a conical reducer for permitting only wires of predetermined gauge to pass therethrough. After the second portion is secured to a base of the insulating housing, a wall portion of a cap may be slidable mounted between the first and second walls of the first portion. The wall portion has an opening therein to permit a wire to pass between wire receiving openings in the first and second walls. An insulated wire can be inserted through an opening in the insulating housing into the wire receiving openings. The cap can then be turned to cause the first portion to rotate relative to the second portion which in turn causes the insulated wire to become terminated in the wire receiving slots.

35 Claims, 15 Drawing Sheets

INSULATION DISPLACING BARREL TERMINAL

BACKGROUND OF THE INVENTION

1. Field of the Invention

This invention relates to an insulation displacing barrel terminal having a first portion, a second portion and a connecting portion connecting said first and second portions, wherein said connecting portion is torsional to permit the first portion to rotate relative to the second portion in order to cause an insulated wire to be terminated in the terminal.

2. Description of the Prior Art

There are many instances where terminal blocks are set up and raised to receive insulated wires. Many of these terminal blocks are simply threaded members fixed with insulation material which receive wires either wrapped around the threaded members and secured thereto by an application of a nut, or the wires are terminated by known spade or ring terminals and then secured to the threaded member by a nut. While these have, in some instances, provided effective means for termination, they have not always been convenient for maintenance or repair, and they frequently are subjected to environmental degradation with a resulting loss of desired electrical characteristics. There is a need, predominantly within the telecommunications industry, for reusable terminals and terminals which can accommodate insulated wires having conductors of various sizes. For example, telephone wires coming from the telephone company, termed distributor wires, can either be in the form of multi-wire buried cable or aerial cable, which wires must be connected to particular wires extending to telephone at particular sites. The terminal blocks would be mounted in either an enclosure on the aerial mount, or in an enclosure pedestal affixed to the ground or on a pole. As new telephones are installed in a selective locality, an end of each phone wire is coupled or terminated to an appropriate terminal on the terminal block. There is also a need, particularly in applications where insulated wires are to be terminated in the field, that the conductors of the insulated wires be easily installed or affixed to the terminal. As many wires are required for operation, it is essential that the installation of the wires be accomplished with minimal effort and tooling. Generally, such terminal blocks include stub cables previously affixed thereto with discrete wires joined at one end to respective terminals in the block and the terminations sealed such as by potting; the terminated ends of the discrete wires of the stub cable are then to be spliced in the field to appropriate ones of the distribution wires outside of the terminal block.

The insulated wire sizes within the industry are not always the same gauge and therefore the terminals must be designed to accommodate more than one wire size. A typical size wire, running from the terminal block to the phone installation is copper-clad steel wire with a gauge of 18½ AWG although other phone installations use copper wire having a gauge of 20–24 AWG. It can be appreciated, then, that a terminal having a higher quality means for terminating conductors, and having means to accommodate more than one insulated wire size, would be a substantial improvement within the industry. While the preferred embodiment of the terminal disclosed herein is for telecommunication applications, for example, for electrical interconnection of tip and ring signals, the invention could be used with other wire sizes and in other applications.

U.S. Pat. No. 4,431,247 shows an insulated terminal and module; however, the shell of the terminal includes only one wire opening for insulation displacement. Other previous designs are shown in U.S. Pat. Nos. 4,637,675 and 4,705,340 where stationary terminals are located within housings and rotatable caps are placed over the terminals. Rotation of the cap causes the wires within the caps to be rotated into the stationary insulation displacement portions.

Another previous design is shown in U.S. Pat. No. 5,006,077 which discloses a multiple-piece terminal which has a first section which remains stationary relative to a housing of the terminal and which also has separate rotatable sections which are rotatable on and relative to the first section.

The designs shown in U.S. Pat. Nos. 4,705,340 and 4,637,675 turn the wire into the slot which causes a bending of the wire. This bend, particularly in steel wire, causes a stored energy spring effect which can tend to become loosened over time.

The previous terminal designs shown in U.S. Pat. Nos. 4,705,340 and 4,637,675 are of one-piece construction and eventually become potted within a housing. The one-piece design leads to difficulty if one of the terminals becomes damaged and the terminals need to be replaced. To replace one of the terminals, the potting material has to be removed around the terminal, re-terminated to one of the telephone company wires, and then re-potted.

The U.S. Pat. No. 5,006,077 discloses a two-piece insulation barrel displacing terminal having a first cylindrical connector section coupled to an insulative housing. A rotatable section is mounted on the first section and rotated with respect thereto to terminate the conductor of the wire within the slot of the terminal. Another problem with the two-piece design of the '077 reference is that it was not uncommon that the electrical connection between the first section and the rotatable second section was not effective, for example, because the first and second sections would corrode. Also, because the second section remains fixed with respect to the housing, it could not terminate a wire in the same manner that a wire could be terminated in the first section.

While the previous versions are excellent designs, these designs include shortcomings which have been addressed by the instant design.

SUMMARY OF THE INVENTION

It is, therefore, an object of the present invention to provide an insulation displacing terminal which is a one-piece construction and which has means for permitting a first portion of the terminal to rotate relative to a second portion of the terminal in order to cause an insulated wire to be terminated in the first portion.

In one aspect, this invention provides a terminal comprising: a first portion; first coupling means located on the first portion for coupling a first wire to the terminal; a second portion; second coupling means located on the second portion for coupling a second wire to the terminal; and a torsion coupler connecting the first and second portions, said torsion coupler being torsional to permit the first and second portions to be rotated relative to each other, whereby the rotation of the first portion causes the first coupling means to couple the first wire to the terminal after the first wire is inserted in the first coupling means. In several embodiments, the second portion is held stationary in the housing, and a second wire, such as a discrete wire of a stub cable, can be coupled to the second coupling portion beneath the housing by insulation displacement. In another embodiment, an intermediate portion is held fixed against rotation and the first and second portions are separately rotatable to terminate to respective wires or pairs of wires, including direct termination to a distribution wire.

Another object of the present invention is to provide a one-piece insulation displacing terminal having a plurality of wire openings on one or both ends for terminating wires at either end of the terminal.

Another object of this invention is to provide an insulation displacing terminal that is a one-piece construction stamped from a conductive material.

Another object of this invention is to provide an insulation displacing terminal for terminating insulated wires having conductors of various gauges.

Yet another object of the invention is to provide an insulation displacing terminal which will permit an insulated wire to be terminated in the terminal without causing the wire to bend.

These objects, and others, may be more readily understood in connection with the following specification, claims, and drawing.

DESCRIPTION OF THE PREFERRED EMBODIMENTS

Figure 1:
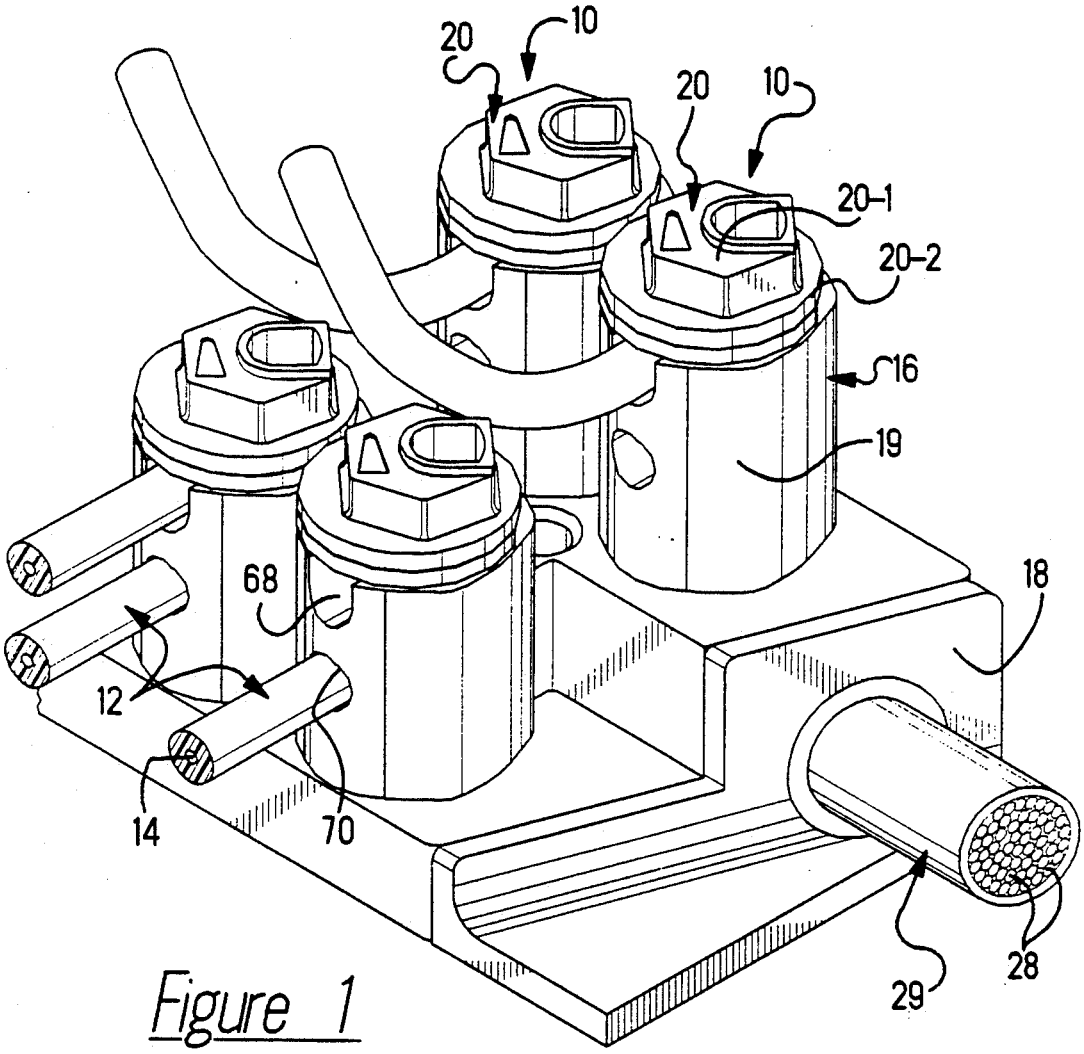
FIG. 1 is a perspective view showing a portion of a high density array of insulation displacing connector assemblies.
Figure 2:
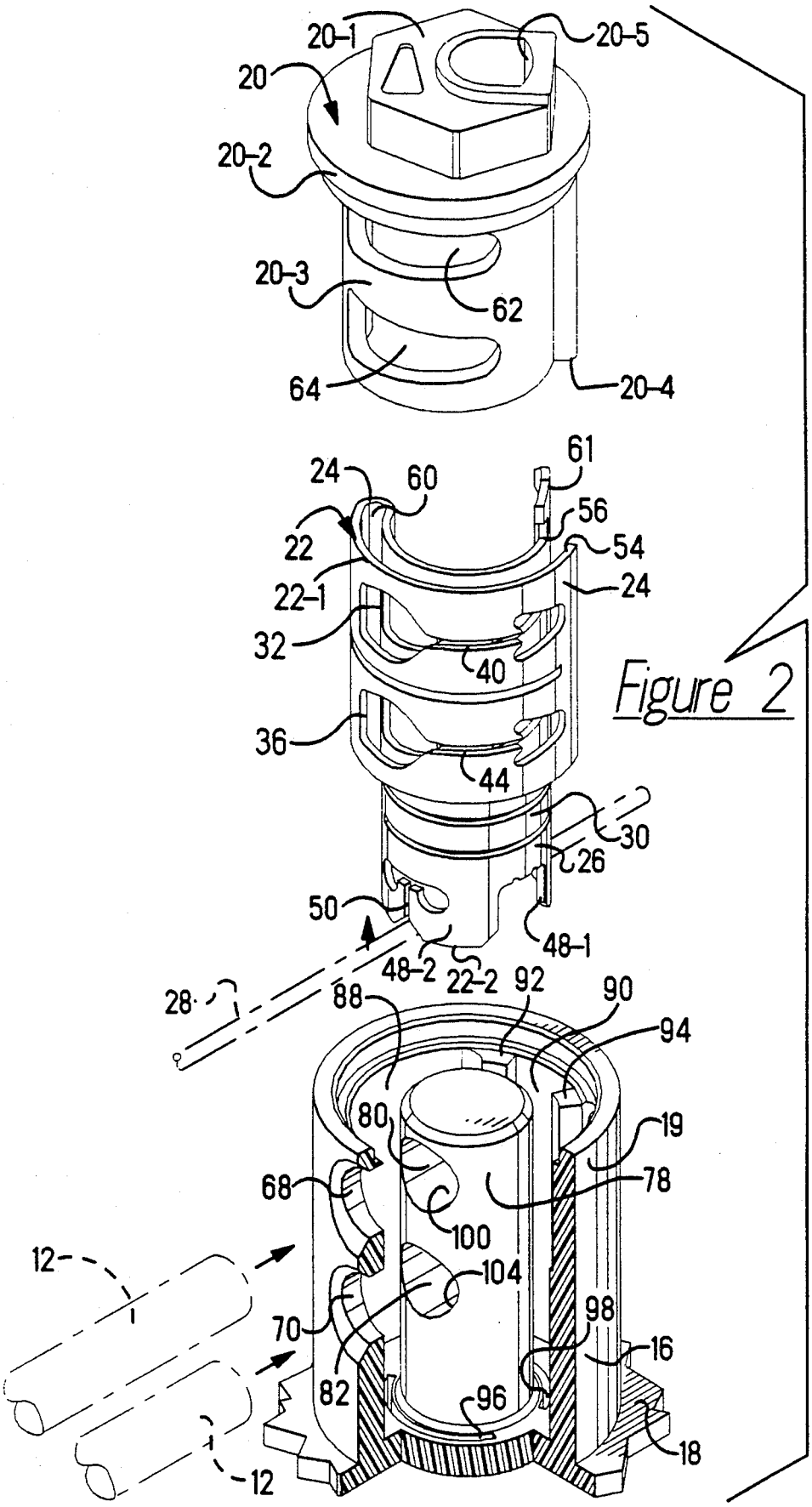
FIG. 2 is a perspective exploded view of one of the insulation displacing terminals, showing a one-piece terminal of the present invention.
Figure 3:
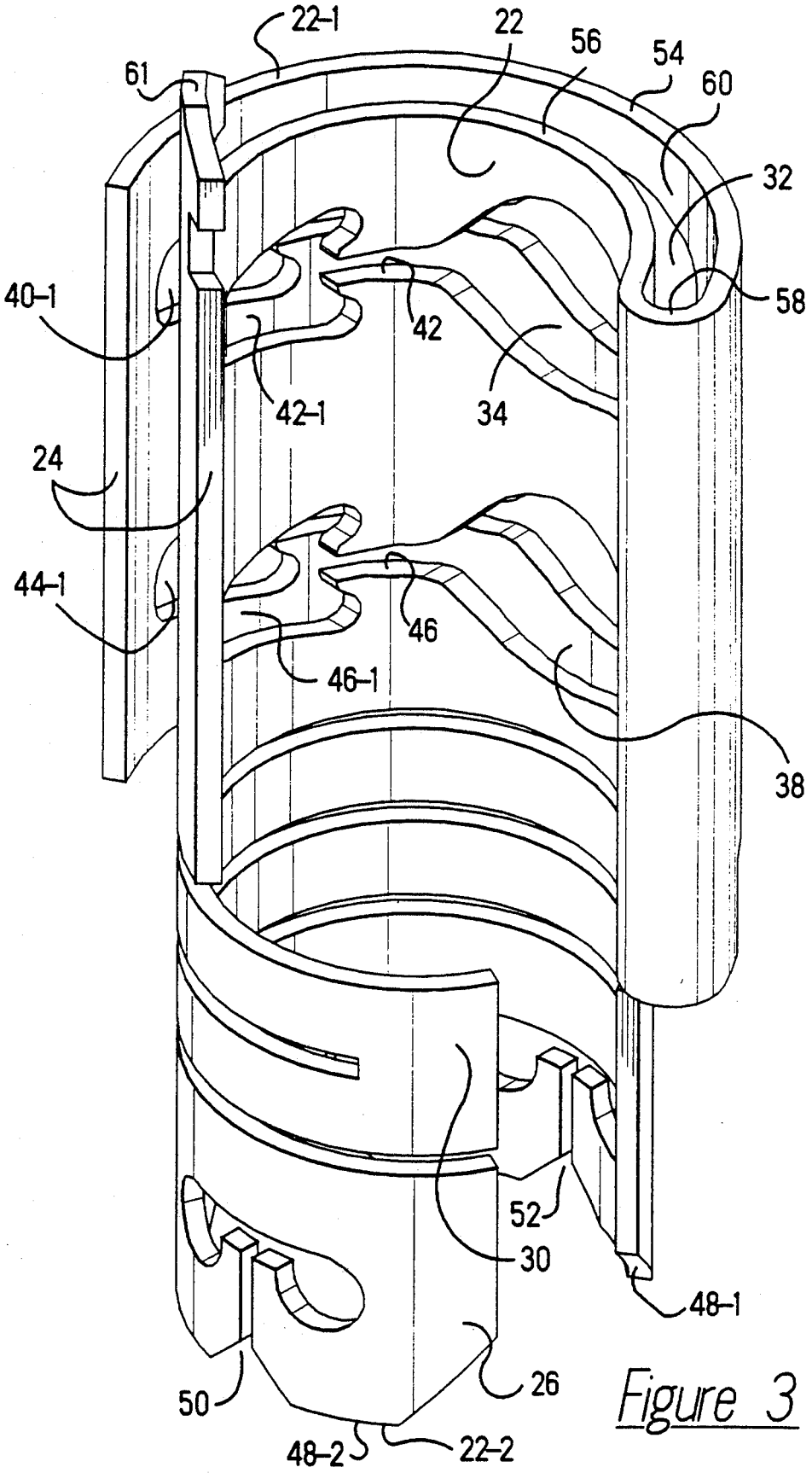
FIG. 3 is a perspective view showing the one-piece terminal of FIG. 2 from rearwardly thereof.
Figure 9:
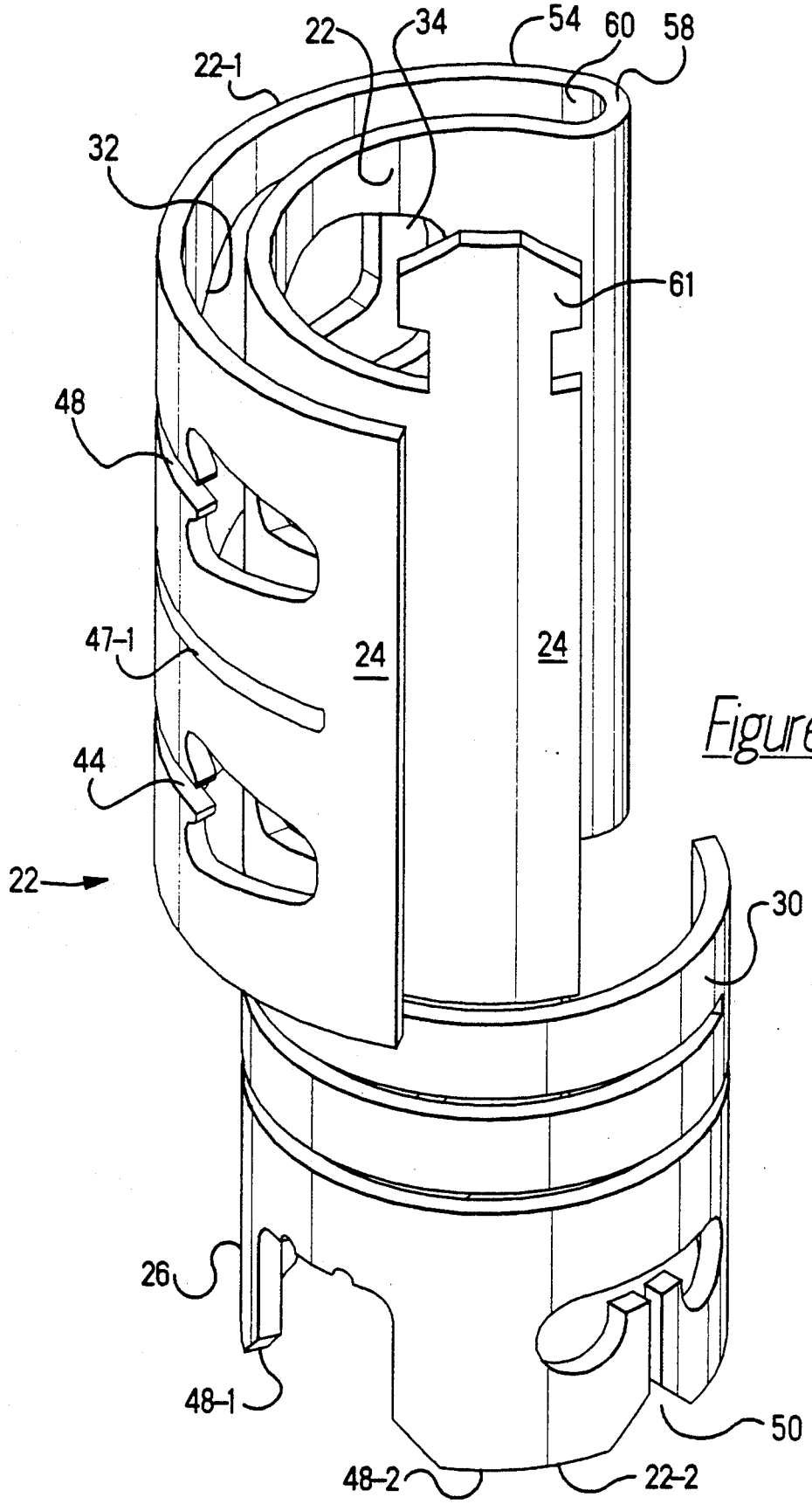
FIG. 9 is another perspective view of the terminal shown in FIG. 3.

FIG. 1 is a perspective view showing a high density array of insulation displacing connector assemblies 10, according to a preferred embodiment of the invention. The function of each of the insulation displacing connector assemblies 10 is to terminate an insulated wire 12 having a conductor 14 so that the conductor 14 is in electrical contact with another conductor of a discrete wire 28 of a stub cable 29 which is spliced to a respective distribution wire (not shown). Commonly, the terminal assemblies can be filled with a dielectric grease or gel to embed all metal surfaces and seal the surfaces against moisture and corrosion. In a preferred embodiment of the invention, the insulation displacing connector assemblies 10 are arranged in two opposed rows, as shown in FIG. 1, and each comprises an insulating housing 16 integrally formed as part of a common base 18. Each of the insulation displacing connector assemblies 10 also comprises a cap 20 having a drive nut portion 20-1 integrally molded above a stepped circular flange portion 20-2. Cap 20 is rotatably mounted on insulating housing 16 and is rotatable with respect thereto. As best shown in FIG. 2, each connector assembly 10 also comprises a terminal 22 which may be slidably mounted inside the insulating housing 16. As illustrated in FIGS. 3 and 9, terminal 22 has a first end 22-1 and a second end 22-2. The first end 22-1 comprises a first portion 24 for connecting the insulated wire 12 (FIG. 1) to the terminal 22. The second end 22-2 comprises a second portion 26 for connecting to the conductor of discrete wire 28 to terminal 22. Each connector assembly 10 is shown to be adapted to receive a pair of such insulated wires 12 to be simultaneously electrically connected to the same discrete wire 28 if desired.

Figure 4:
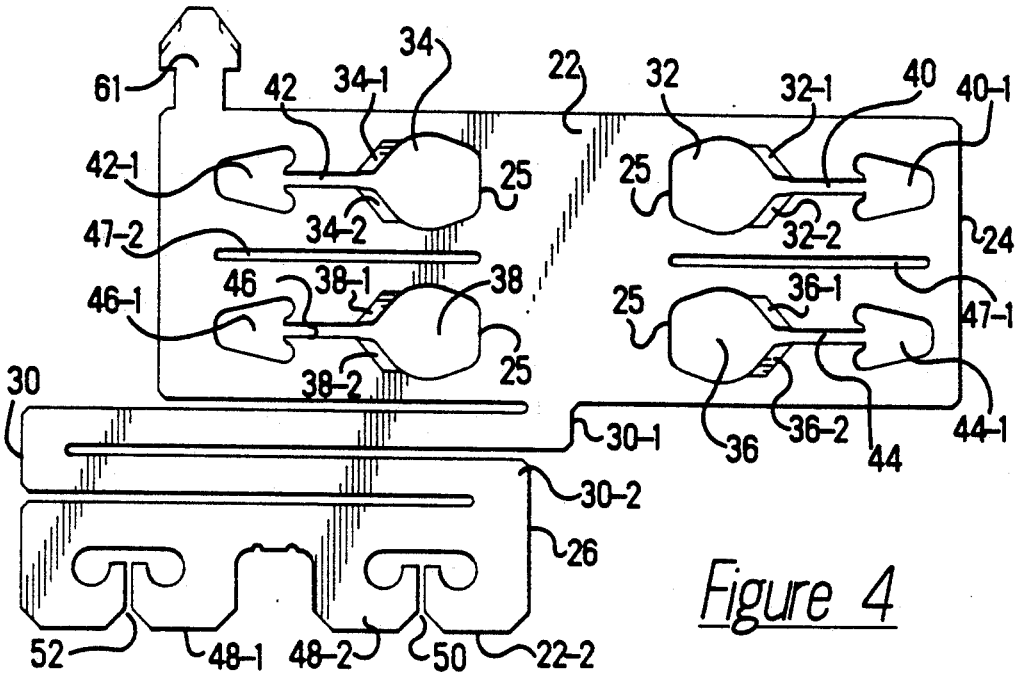
FIG. 4 is a stamped blank of the terminal shown in FIG. 3 prior to being rolled into a barrel terminal.

A connecting portion 30 (FIGS. 3 and 4) connects first and second portions 24 and 26. Connecting portion 30 is integrally formed as part of terminal 22, thereby ensuring electrical continuity between first portion 24 and second portion 26. As best shown in FIG. 4, terminal 22 is stamped from a conductive material prior to being rolled into the form shown in FIGS. 3 and 9. The first portion 24 comprises first coupling means 25 (FIG. 4) for coupling the insulated wire 12 to terminal 22. As shown, the coupling means 25 of terminal 22 comprises a first wire receiving opening 32, a second wire receiving opening 34, a third wire receiving opening 36 and a fourth wire receiving opening 38. The first portion 24 also comprises a first slot 40, a second slot 42, a third slot 44 and a fourth slot 46, which communicate with the wire receiving openings 32, 34, 36, and 38, respectively, as shown. The wire receiving openings 32, 34, 36, and 38 comprise cutting edges 32-1, 32-2, 34-1, 34-2, 36-1, 36-2, 38-1, and 382, which are capable of cutting through the insulation of the insulated wire 12, thereby facilitating guiding the conductor 14 of the insulated wire 12 into the slots 40, 42, 44, or 46. The slots 40, 42, 44 and 46 have relief openings 40-1, 42-1, 44-1 and 46-1, respectively, and slot segments 47-1, 47-2 associated with slots 40, 42, 44, 46 to facilitate termination of wires 12 by enabling incremental widening of the slots by slightly larger diameter conductors 14 being urged into the slots.

In the embodiment being described, the connecting portion 30 is generally S-shaped or serpentine-shaped, as shown in FIG. 4. Connecting portion 30 has a first end 30-1 coupled to the first portion 24 and a second end 30-2 coupled to the second portion 26. After terminal 22 is rolled into the form shown in FIGS. 3 and 9, connecting portion 30 becomes torsional so as to enable the first and second portions 24 and 26 to rotate relative to each other. This feature permits, for example, the first portion 24 to be rotated relative to the second portion 26 when the insulated wire 12 is being terminated, while integrally joining and electrically connecting first and second portions 24, 26.

The second portion 26 comprises second coupling means 48 (FIG. 4), located on the second end 22-2, for coupling terminal 22 to discrete wire 28 (FIG. 1). The second coupling means 48 comprises a pair of insulation displacing slots 50 and 52 which are capable of terminating discrete wire 28. The second portion also comprises a first support member 48-1 and a second support member 48-2 whose function is to secure terminal 22 in base 18 of insulated housing 16 as described later herein.

Referring now to FIG. 3, terminal 22 is conventionally rolled and formed to provide the shape shown in FIG. 3. As illustrated, the first portion 24 is double-backed or generally U-shaped having a first wall 54, a second wall 56 adjacent the first wall 54, and a joining wall 58 joining the first and second walls 54 and 56. The generally U-shaped first portion 24 defines a generally U-shaped area or gap 60 which can receive a wall portion 20-3 (FIGS. 2 and 11) of cap 20. As illustrated in FIG. 3, first and second walls 54 and 56 are adjacent and are generally semi-circular or arcuately shaped. The first and third wire receiving openings 32 and 36 and slots 40, 44 are located on first wall 54, and the second and fourth wire receiving openings 34 and 38 and slots 42, 46 are located on second wall 56. In the embodiment being described, first and third wire receiving openings 32 and 36 and slots 40, 44 are aligned with and directly opposed to second and fourth wire receiving openings 34 and 38, and slots 42, 46, respectively. A probe-engageable tab 61 extends upwardly to facilitate continuity testing, allowing assembly and wire termination.

Figure 11:
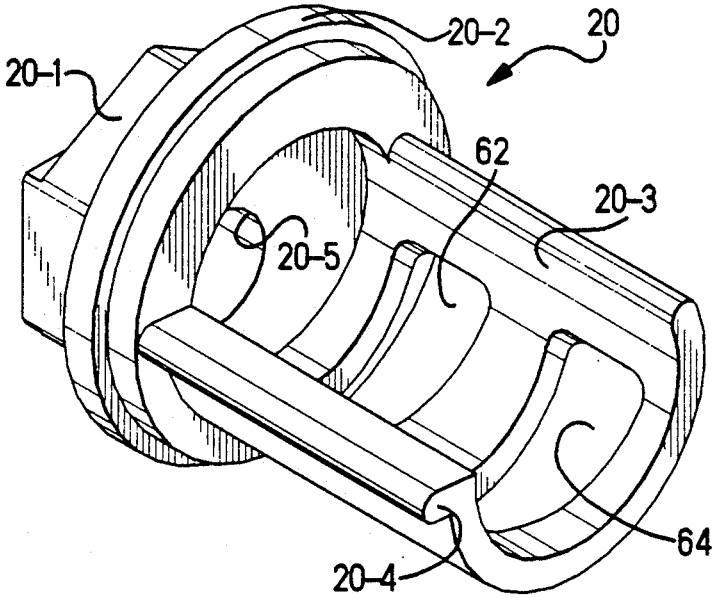
FIG. 11 is an isometric view of the cap of FIG. 2.

As best illustrated in the exploded view of FIG. 2, the wall portion 20-3 of cap 20 is received in the generally U-shaped gap 60 when cap 20 is slidably mounted on the terminal 22 until flange portion 20-2 abuts the top of wall 19 and probe-engageable tab 61 is exposed in probe-receiving opening 20-5. Lateral flanges of tab 61 latch over corresponding ledges (not shown) in opening 20-5, thus securing cap 20 in position in assembly 10. As will be described later herein, the wall portion 20-3 is capable of engaging and rotating the first portion 24 of terminal 22 in response to the rotation of cap 20 in a clockwise direction (as viewed in FIG. 2). As shown in FIGS. 2 and 11, cap 20 comprises a pair of cap openings 62 and 64. Cap opening 62 becomes operatively aligned between first and second wire receiving openings 32 and 34, and cap opening 64 becomes operatively aligned between third wire receiving opening 36 and fourth wire receiving opening 38, when cap 20 is received in generally Unshaped area 60. As shown in FIGS. 2 and 11, the wall portion 20-3 of cap 20 has a detent 20-4 thereon.

Figure 10:
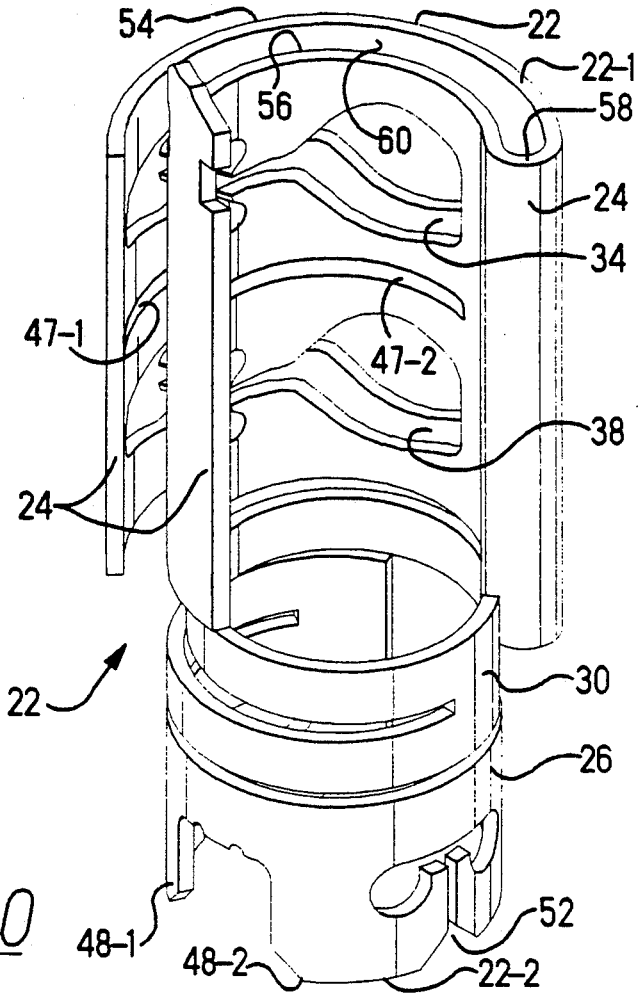
FIG. 10 is a perspective view, showing the terminal shown in FIG. 9, with a first portion of the terminal in a closed and torqued position.

Referring to FIG. 2, each insulating housing 16 comprises a cylindrical wall 19 for receiving a terminal 22 and a cap 20. In the embodiment being described, cylindrical wall 19 comprises a pair of wall openings 68 and 70 (FIG. 1) for receiving one or two insulated wires 12. The cylindrical wall 19 also comprises an arcuate recess 72 (FIGS. 7 and 8) extending between a first recess 74 and a second recess 76. Detent 20-4 (FIGS. 2 and 11) on wall portion 20-3 cooperates with the first and second recesses 74 and 76 (FIGS. 7 and 8) to secure or lock the cap 20 and the first portion 24 of terminal 22 in either an open position (FIG. 7) or a closed position (FIG. 8), respectively. When cap 20 and the first terminal portion 24 are in the open position shown in FIGS. 5 and 7, an insulated wire 12 is inserted in either wall opening 68 or wall opening 70 (or separate wires 12 are inserted in each, if desired). The insulated wire 12 can then be terminated in terminal 22 by rotating cap 20 from the open position to the closed position shown in FIGS. 6 and 8. FIGS. 9 and 10 show terminal 22 as it would appear in the open and closed positions outside of cylindrical housing 19, and it illustrates how the connecting portion 30 becomes torqued to permit first terminal portion 24 to be rotated relative to second terminal portion 26.

Figure 7:
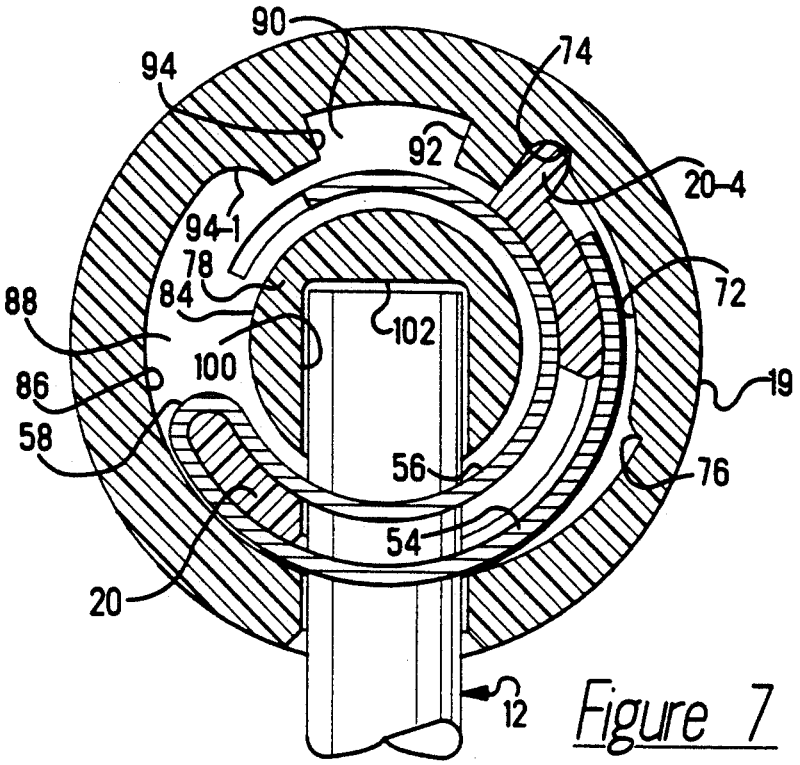
FIG. 7 is a sectional view, taken along the lines 7—7 of FIG. 5, showing the insulation displacing barrel terminal in the open position.
Figure 8:
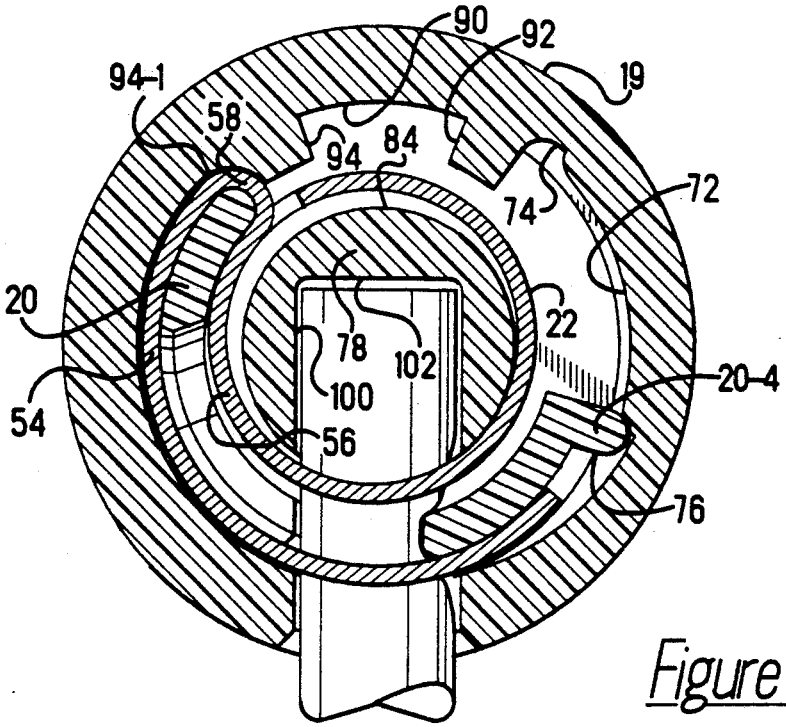
FIG. 8 is a sectional view, taken along the line 8—8 of FIG. 6, showing the insulation displacing barrel terminal in the closed position.

As best shown in FIG. 2, insulating housing 16 further comprises a post 78 which extends upwardly (as viewed in FIG. 2) and integrally from base 18. Post 78 has a pair of post openings 80 and 82 which are generally aligned with wall openings 68 and 70, respectively. As best shown in FIGS. 7 and 8, post opening 80 is defined by a cylindrical wall 100 and a terminating wall 102. Although not shown, post opening 82 is similarly constructed. An outer diameter 84 (FIGS. 7 and 8) of post 78, and an inner diameter 86 of insulating housing 16 define a terminal receiving area 88 for receiving terminal 22.

Figure 5:
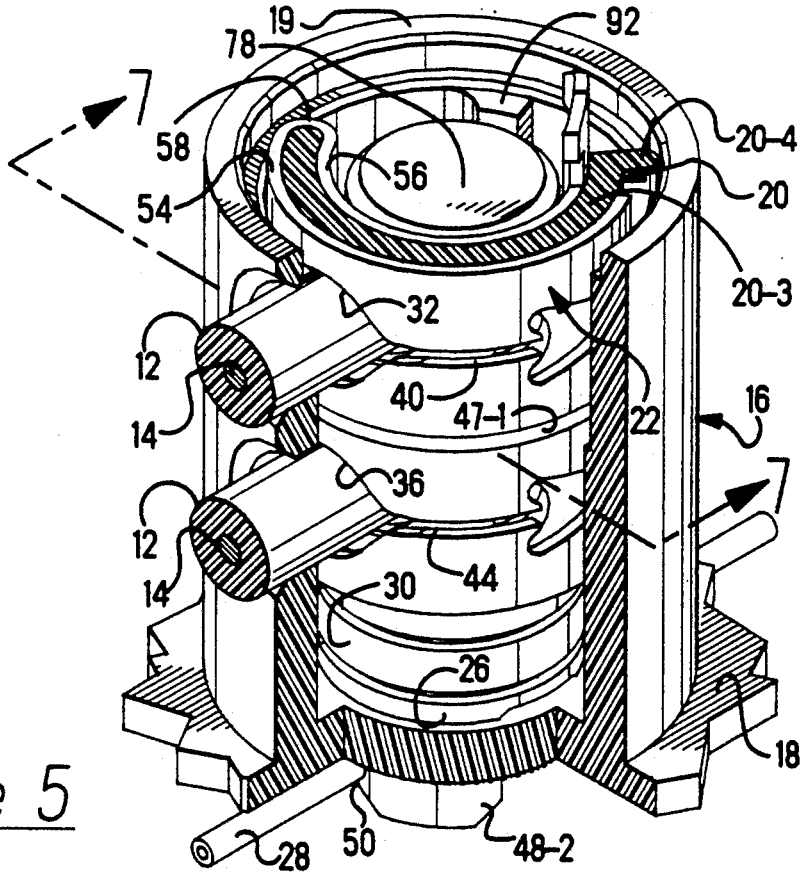
FIG. 5 is a perspective sectional view, partially broken away, showing the one-piece terminal in an open position in a cylindrical housing.
Figure 6:
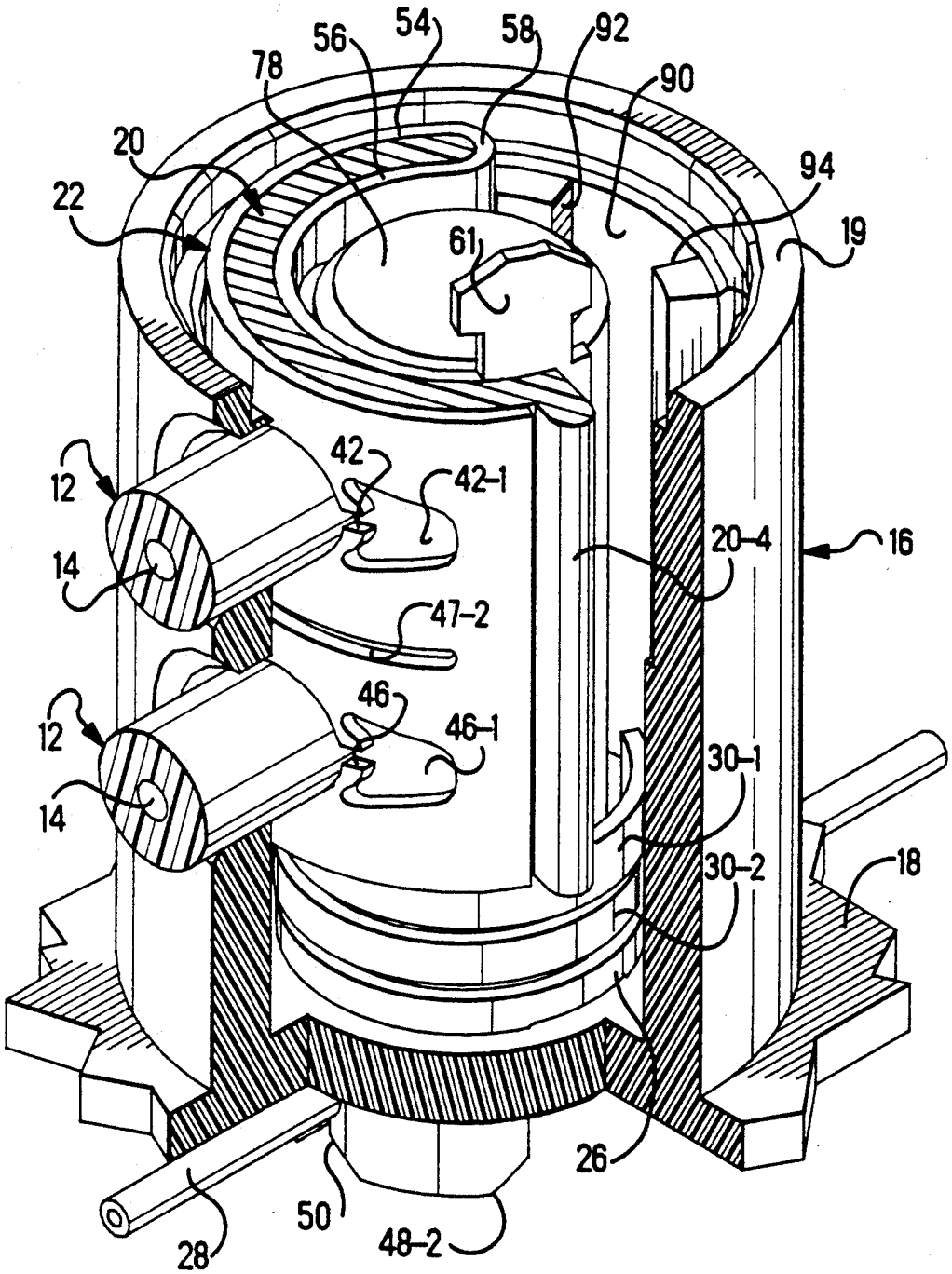
FIG. 6 is a perspective sectional view, partially broken away, showing the one-piece terminal in a closed position.

Base 18 of insulating housing 16 also comprises a first arcuately-shaped slot 96 and a second arcuately-shaped slot 98, as shown in FIG. 2. A function of the first and second arcuately-shaped slots 96 and 98 is to receive thereinto by force-fit a first support member 48-1 and a second support member 48-2, respectively, of the second portion 26 of terminal 22. Such arrangement defines a cooperating means for stopping the rotation of the second terminal portion 26 with respect to the first terminal portion 24 when the first terminal portion is rotated. After the first and second support members 48-1 and 48-2 of second portion 26 have been inserted through the first and second arcuately-shaped slots 96 and 98, respectively, support members 48-1 and 48-2 depend from base 18 of insulating housing 16, as shown in FIGS. 5 and 6. This permits discrete wire 28 to be forcibly engaged or terminated at two locations (redundancy) in slots 50 and 52 (FIG. 3) of second coupling means 48, each of which pierces the insulation of wire 28 to mechanically engage the conductor therein under compression to define an electrical connection therewith. After all such wires 28 are terminated to all the terminals 22 of the array, preferably the region below connector assemblies 10 is potted such as with polyurethane encapsulating resin for environmental sealing which also assists in securing second terminal portions 26 to base 18 at the factory site to define an assembled terminal block and stub cable 24 prior to application of the terminal block to service wires 12 at the site of respective telephones in the field.

After terminal 22 is slidably mounted in terminal receiving area 88 (FIG. 2), cap 20 is slidably mounted on terminal 22. In this regard, wall portion 20-3 of cap 20 is slidably mounted between the first and second walls 54 and 56 of the first portion 24 of terminal 22. It should be noted that when the insulation displacing connector assembly 10 is assembled and is in the open position (FIG. 7), the cap opening 62, first and second wire receiving openings 32 and 34, and post opening 80 are all in radial alignment with the center of a channel 90. The channel 90 is defined by stop surfaces 92 and 94 of insulating housing 16. Likewise, cap opening 64, third and fourth wire receiving openings 36 and 38, and post opening 82 are all in radial alignment with the center of channel 90.

The termination of the insulated wire 12 in terminal 22 will now be described. When it is desired to terminate an insulated wire 12 in the first portion 24 of terminal 22, the wire 12 is inserted into either wall opening 68 (FIG. 2) or the wall opening 70. For example, the insulated wire 12 may be inserted through the first and second wire receiving openings 32 and 34 and cap opening 62 and into post opening 80. As illustrated in FIGS. 7 and 8, after the insulated wire 12 is fully inserted into post opening 80, and into abutment with terminating wall 102, cap 20 is then rotated in a clockwise direction, as viewed in FIG. 7, which in turn causes first terminal portion 24 to rotate towards the closed position shown in FIG. 8. As cap 20 causes first terminal portion 24 to rotate relative to second terminal portion 26, the insulation on the insulated wire 12 is pierced and displaced by the opposed edges defining first and second slots 40 and 42, respectively, and the opposed edges compress against the conductor 14 defining a pair of electrical connections therewith. Slots 40, 42 are incrementally widened by conductor 14 to assure a desired level of mechanical compression therewith; relief openings 40-1, 42-1, 44-1, 46-1 and slot segments 47-1, 47-2 allow incremental lateral deflection of the terminal portions adjacent slots 40, 42, 44, 46 by conductors 14.

The joining wall 58 of the second portion 26 engages a curved surface 94-1 of stop surface 94 until detent 20-4 of cap 20 is received into second recess 76, thereby locking cap 20 and first terminal portion 24 in the closed position. The redundant termination facilitates providing the electrical connection between the conductor 14 of insulated wire 12 and terminal 22. In this regard, FIGS. 9 and 10 show the first portion 24 of terminal 22 outside insulating housing 16 as it is rotated from the open position (FIGS. 7 and 9) to the closed position (FIGS. 8 and 10). Notice how the connecting portion 30 becomes torqued which permits the first portion 24 to rotate relative to the second portion 26 from the open position to the closed position. With reference additionally to FIGS. 2 through 6, the cavity is shaped and dimensioned, by a wide-enough radial gap between the cavity wall and the post, to define a clearance to permit flexing of the connecting portion 30 of FIGS. 6 to 9, such as by permitting reduction in diameter of connecting portion 30 when stressed.

In the embodiment being described, the first and second wire receiving openings 32 and 34 are the same size, and the third and fourth wire receiving openings 36 and 38 are the same size. It should be noted from FIGS. 7 and 8 that insulated wire 12 remains in a straight condition while it is being terminated. Although not shown, it should be appreciated that third and fourth wire receiving openings 36 and 38 could be larger or smaller than first and second wire receiving openings 32 and 34 in order to accommodate a larger or smaller gauge insulated wire 12.

Figure 12:
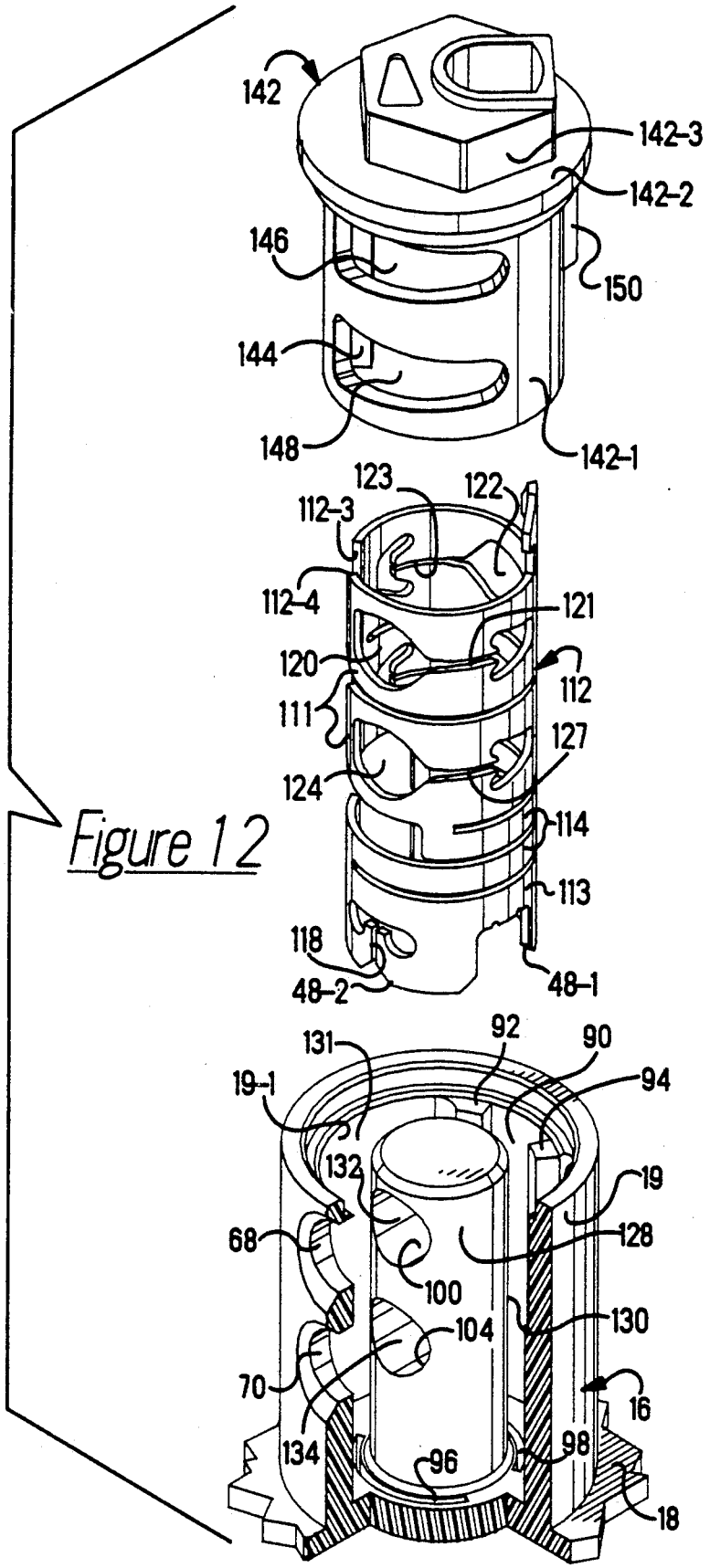
FIG. 12 is an exploded view of another embodiment of the invention, showing a generally cylindrical one-piece terminal.
Figure 13:
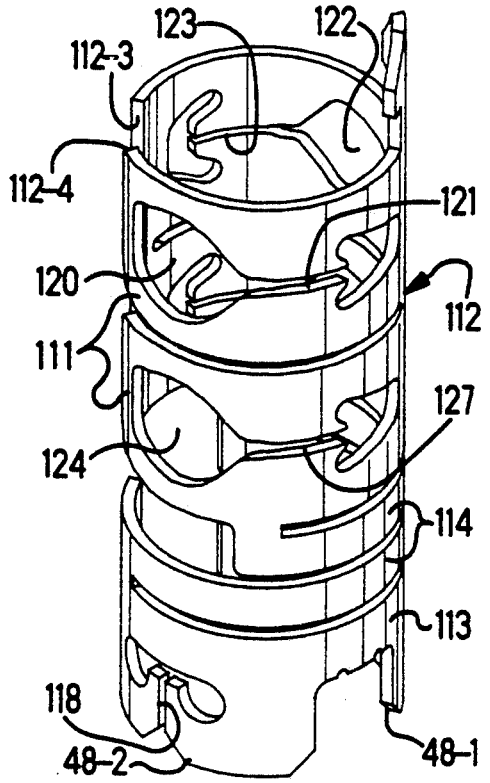
FIG. 13 is a perspective view, showing details of the terminal shown in FIG. 12.
Figure 15:
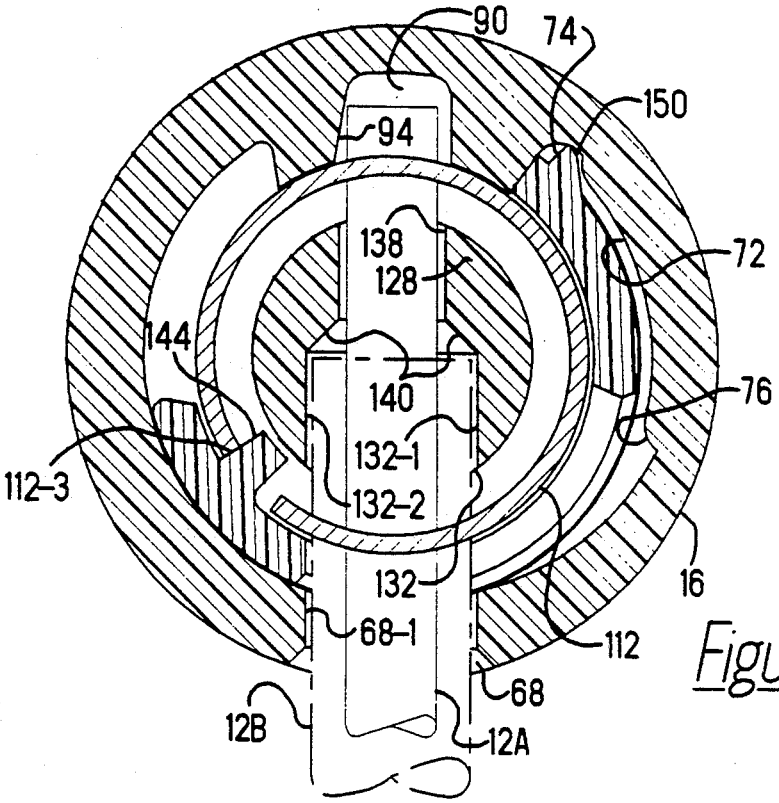
FIG. 15 is a sectional view, taken along the line 15—15 of FIG. 14, showing the terminal in an open position.
Figure 16:
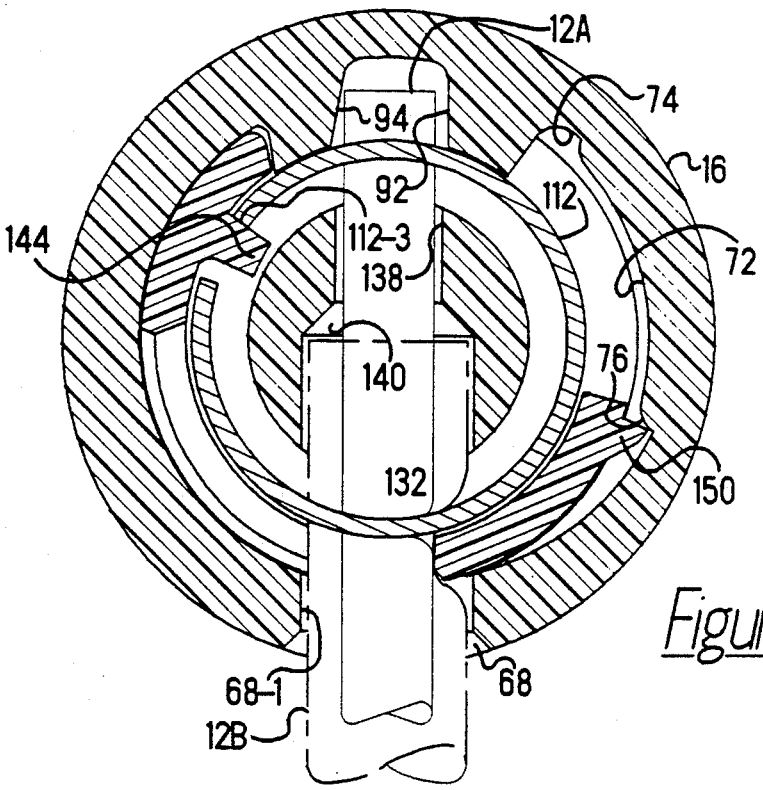
FIG. 16 is a sectional view, similar to that of FIG. 15, except the terminal has been rotated to a closed position.
Figure 17:
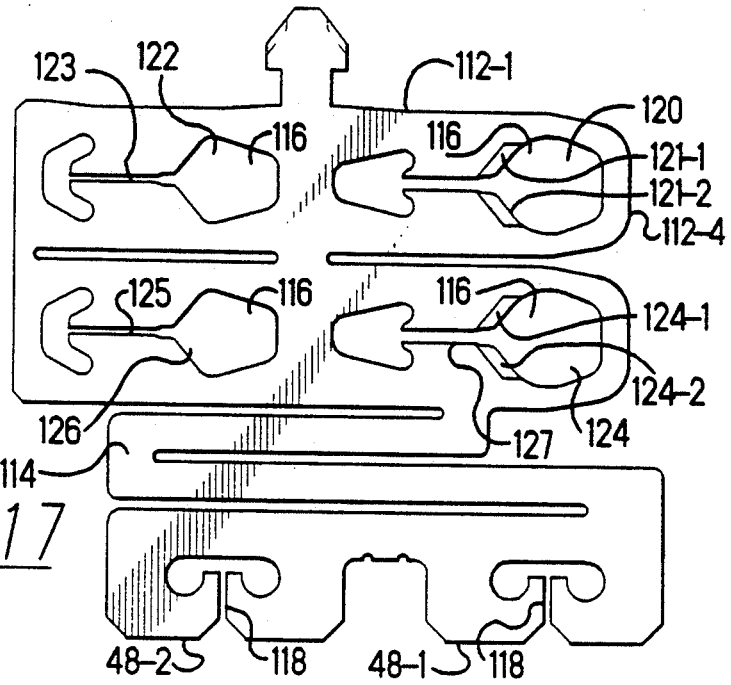
FIG. 17 is a stamped blank of the terminal shown in FIG. 12, prior to being rolled into a barrel shape.

An alternate embodiment of the invention is shown in FIGS. 12–17. In order to avoid unnecessary descriptions, those elements in FIGS. 1–11 which are identical to corresponding elements in FIGS. 12–17 are given the same number designation. For example, cylindrical wall 19 in FIG. 1 corresponds to cylindrical wall 19 in FIG. 12. In this embodiment, a terminal 112 is stamped from a conductive material, as shown in FIG. 17. Terminal 112 comprises a first portion 111 located on a first end 112-1, a second portion 113 located on a second end 112-2, and a connecting portion 114 connecting first and second portions 111 and 113. Connecting portion 114 is torsional and operates to permit first portion 111 to rotate relative to second portion 113 in substantially the same way as connecting portion 30 described earlier herein with respect to terminal 22. Terminal 112 further comprises first securing means 116 (FIG. 17) located on first end 112-1 and a second securing means 118 located on second end 112-2. The first end 112-1 comprises side edges 112-3 and 112-4. First securing means 116 comprises a large wire receiving opening 120 and associated small wire receiving opening 122, a large wire receiving opening 124 and associated small wire receiving opening 126. The large wire receiving openings 120 and 124 have relatively wide slots 121 and 127, respectively, communicating therewith while small wire receiving openings 122, 126 have narrow slots 123, 125 communicating therewith, as shown in FIG. 17. As shown in FIGS. 12 and 13, terminal 112 is rolled or formed into a barrel shape so that large wire receiving openings 120 and 124 are opposed to and in alignment with small wire receiving openings 122 and 126, respectively.

The insulating housing 16 (FIGS. 12, 15, and 16) used in this embodiment of the invention includes a generally solid post member 128 which is integrally molded as part of base 18 of insulating housing 16. The outer surface 130 of post 128 forms a terminal receiving area 131 (FIG. 12) in conjunction with inner surface 19-1 of cylindrical wall 19. Post member 128 comprises two post openings 132 and 134 which are included in post 128 and which are radially aligned with wall openings 68 and 70, respectively. The upper post opening 132 includes spaced apart walls 132-1 and 132-2 which are in transition with a reducer means which permits only insulated wires 12 having a gauge which is less than or equal to a predetermined gauge to pass through the post opening 138 and to channel 90. In the embodiment being described, the predetermined gauge is 20–24 AWG wire. The lower post opening 134 is constructed in a similar manner as post opening 132. As best illustrated in FIGS. 15 and 16, the reducer means includes a conical wall 140 formed in post opening 132. It should be noted that wall opening 68, cap opening 146, post opening 132, and post opening 138 are all in radial alignment with the center of channel 90.

Figure 14:
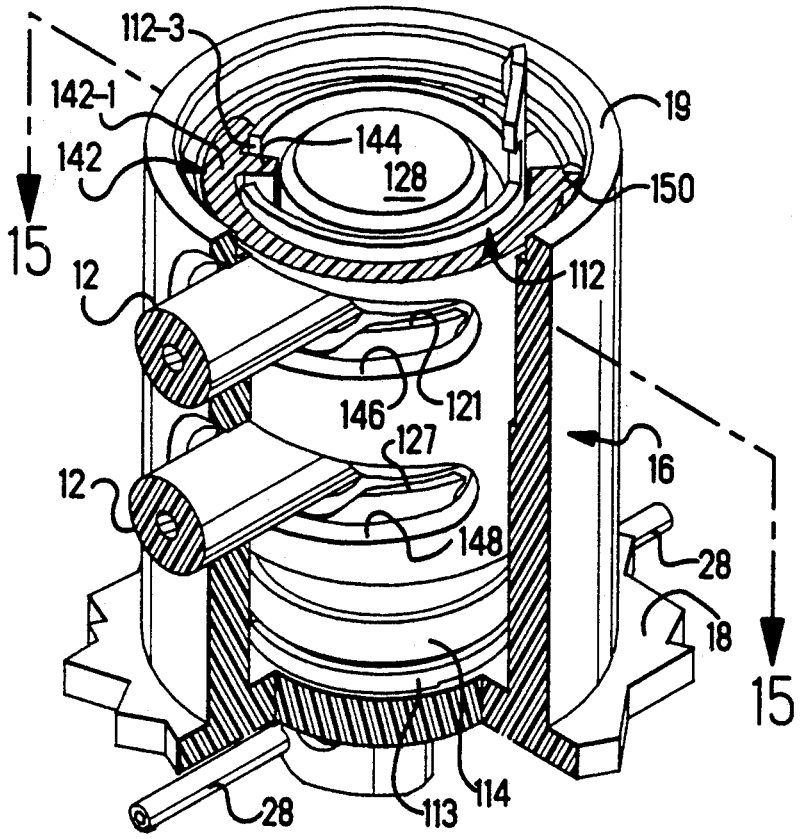
FIG. 14 is a perspective view, partly broken away, showing the terminal of FIG. 12, mounted in the cylindrical housing and in an open position.

Referring now to FIG. 12, a cap 142 is shown including a wall portion 142-1, circular flange 142-2, and a nut or lug portion 142-3 which are integrally molded as part of cap 142. Cap 142 is similar to cap 20, except that wall portion 142-1 of cap 142 includes an engaging member 144 (FIG. 14). Engaging member 144 engages the edge 112-3 (FIG. 17) to rotate the first terminal portion ill clockwise (as viewed in FIGS. 15 and 16) in response to the clockwise rotation of cap 142. Cap 142 also comprises two cap openings 146 and 148 which become generally aligned with post openings 132 and 134, respectively, when cap 142 is slidably mounted between terminal 112 and cylindrical wall 19. Wall portion 142-1 also includes a detent member 150 which engages the first recess 74 or second recess 76 to retain the cap 142 and first terminal portion 111 in the open position (FIG. 15) or closed position (FIG. 16), respectively.

The second terminal portion 113 (FIG. 12) is secured to base 18 of insulated housing 16 in the manner described previously herein with regard to the second portion 26 of the terminal 22. As with terminal 22, the second portion 113 of terminal 112 remains rotationally stationary with respect to the insulating housing 16. After terminal 112 is mounted on the post member 128, cap 142 is slidably mounted on terminal 112 so that engaging member 144 on wall portion 142-1 lies between edges 112-3 and 112-4. As best shown in FIGS. 15 and 16, engaging member 144 engages edge 112-3 to rotate the first portion from the open position shown in FIG. 15 to the closed position shown in FIG. 16.

When it is desired to terminate an insulated wire 12 (such as insulated wire 12A in FIGS. 15 and 16), having a diameter which is smaller than post opening 138, the wire may be inserted in wall opening 68, through cap opening 146 and large wire receiving opening 120 until it is guided into post opening 132. Once in post opening 132, conical wall 140 guides an end of the small insulated wire 12A through post opening 138, through small wire receiving opening 122 of terminal 112 and into channel 90. When cap 142 is then rotated from the open position (FIG. 15) to the closed position (FIG. 16), narrow slot 123 (FIG. 17) associated with small wire receiving opening 122 displaces the insulation on the insulated wire 12A and terminal 112 becomes conductively engaged with the conductor thereof. Relatively wide slot 121 at least compressively engages the insulation of wire 12A at wire receiving opening 68 to provide strain relief benefits.

In order to terminate an insulated wire 12 (such as insulated wires 12B shown in phantom in FIGS. 15 and 16) with diameters larger than the diameter of post opening 138, the wire is guided into post opening 132 until it engages and abuts conical wall 140. After the larger insulated wire 12B is inserted into one of post openings 132 or 134, cap 142 is rotated in the clockwise direction, as viewed in FIGS. 15 and 16, until detent member 150 passes along arcuate recess 72 within the interior of insulating housing 16. The rotation of cap 142 causes edges 121-1 and 121-2 (FIG. 17) to cut through the insulation on insulated wire 12B so that the conductor 14 of the insulated wire 12B becomes compressibly engaged within slot 121 and is in electrical contact with terminal 112. Continued rotation of cap 142 causes cap 142 to move to the closed position, shown in FIG. 16, where detent 150 is received in second recess 76.

It should be appreciated that post member 128 acts as a selector for the particular gauge of insulated wire to be inserted to an appropriate depth within the insulation displacing terminal, and it also acts as a stop surface for the anti-rotation of insulated wire 12 during the termination of the wire. Further abutment is provided by stop surfaces 92 and 94, edge 68-1 of wall opening 68, and edge 70-1 of wall opening 70. The one-piece construction of terminals 22 and 112 permits electrical continuity between insulated wire 12 and discrete wire 28 when both are connected to the terminal.

Figure 18:
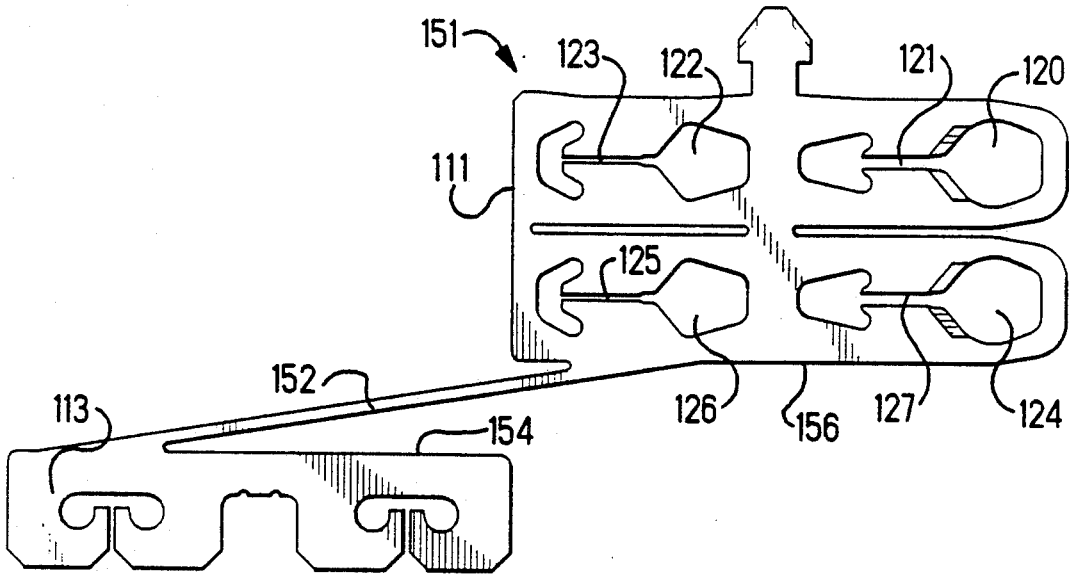
FIG. 18 is a stamped blank view, similar to that of FIG. 17, showing a different embodiment of the torsion strap.
Figure 19:
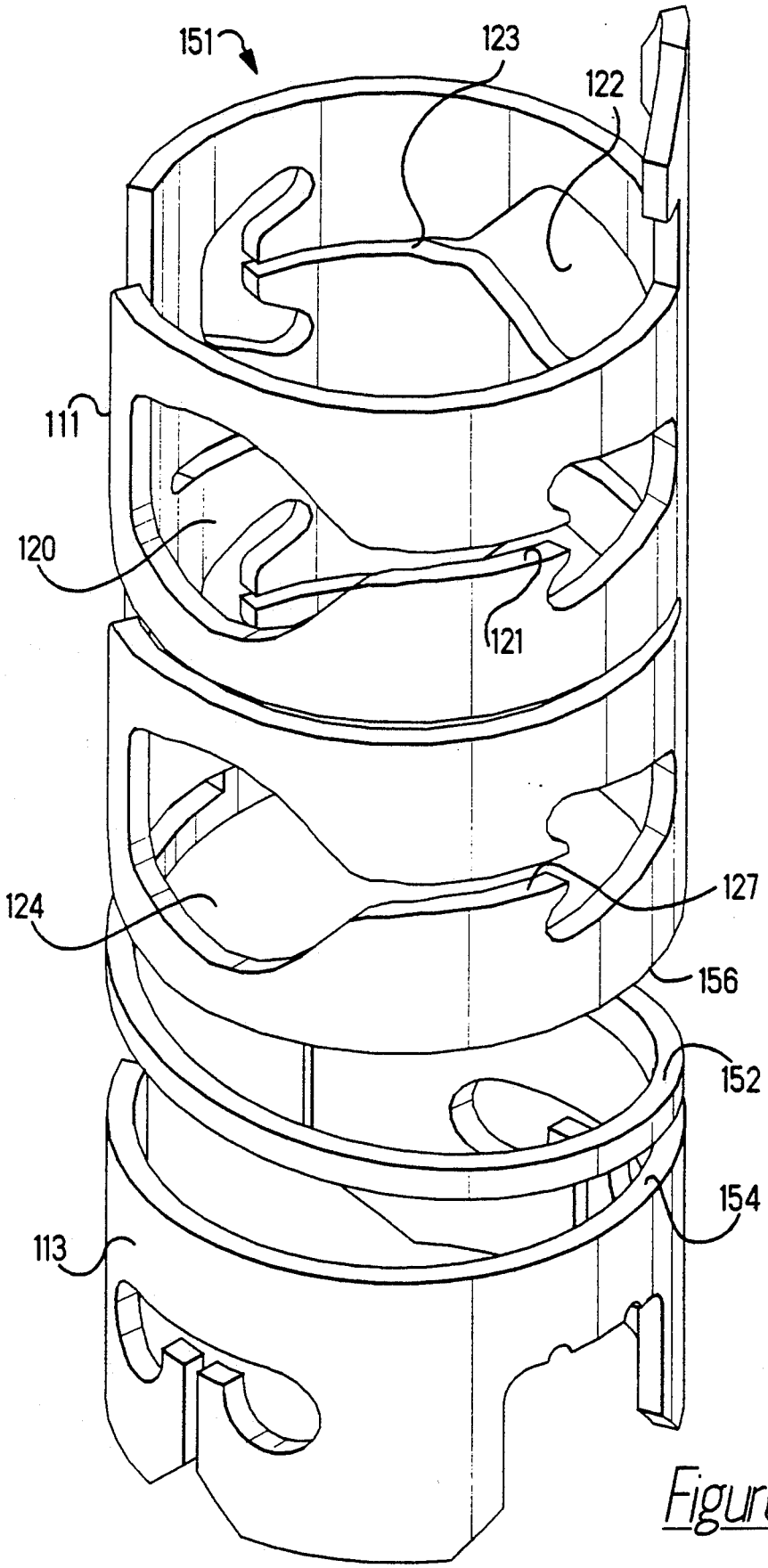
FIG. 19 is a perspective view of the terminal shown of FIG. 18 after it is rolled into a barrel.

With reference to FIGS. 18 and 19, an alternate embodiment 151 of the terminal of FIGS. 12-17 is shown wherein the connecting portion includes a torsional strap 152, different from strap 114 of FIG. 17. As illustrated by the blank shown in FIG. 18, torsional strap 152 extends laterally from a top edge 154 of second portion 113 to a bottom edge 156 of first portion 111. Terminal 151 is then rolled into the generally cylindrical barrel shape shown in FIG. 19. When first portion 111 is rotated in the clockwise direction with respect to second portion 113, torsion strap 152 reduces in diameter as would a torsion spring, since upper and lower portions 111, 113 are fixed vertically relative to each other. The installation and operation of terminal 151 is essentially identical to the installation and operation of terminal 112.

Figure 20:
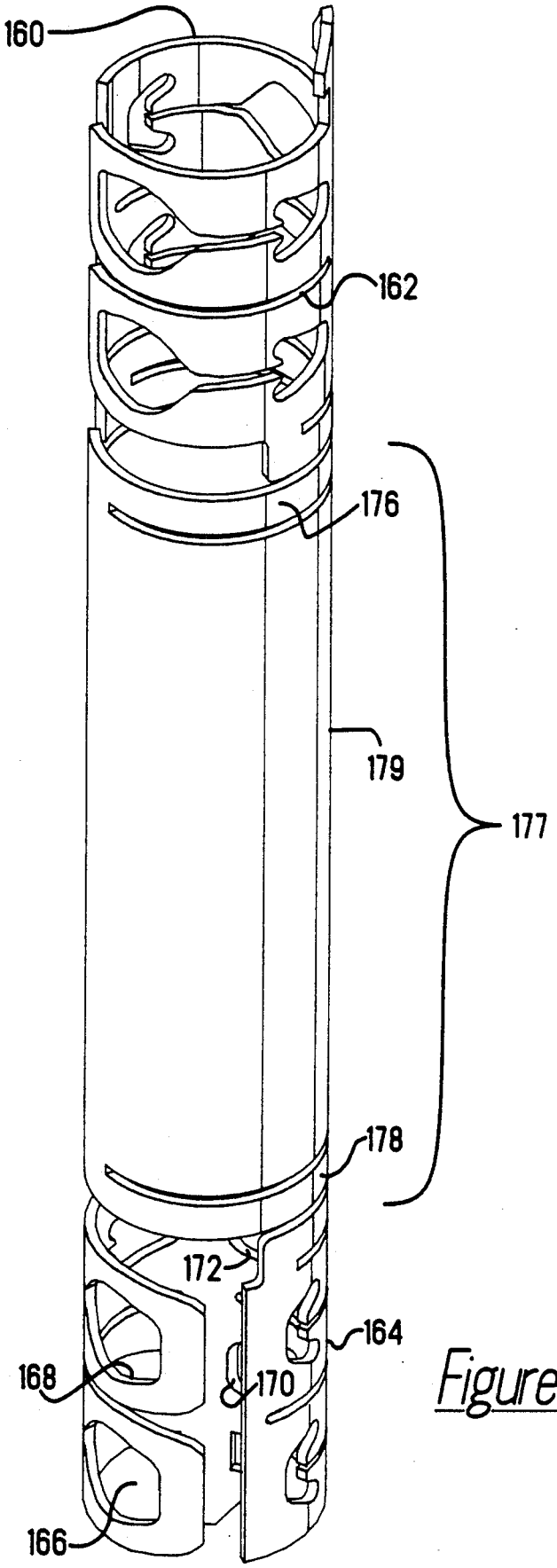
FIG. 20 is a perspective view of another embodiment of the invention, wherein the terminal has a plurality of wire receiving openings on either end thereof.

Referring now to FIG. 20, another embodiment of the invention is shown having a terminal 160. Terminal 160 comprises a first portion 162 which is essentially identical to first portion 111 on terminal 112 (FIG. 13). Terminal 160 also comprises at its opposite end a second portion 164 which is essentially identical to first portion 111, except that second portion 164 includes fifth and sixth large wire receiving opening 166, 168, and seventh and eighth small wire receiving openings 170, 172. In the embodiment being described, the fifth and sixth wire receiving openings 166 and 168 are generally opposed to the seventh and eighth wire receiving openings 170 and 172, respectively. The second portion 164 can effectively be utilized to terminate distribution wires directly (not shown) by a particular distribution wire being severed and both ends thereof inserted into respective openings 166 and 168 for simultaneous termination. Such direct termination of distribution wires to the terminal not only eliminates stub cable 29 and its discrete wires 28 and facilitates manufacture of the terminal block, but also eliminates the necessity of separate splicing procedures and serves to improve the signal transmission by eliminating one entire conductor-to-conductor interface with its concomitant slight signal degradation. Such distribution wires can have a common size (typically 24–26 AWG), and the wire receiving openings 162, 164, 166 and 168 provided can all be of the same configuration.

Terminal 160 also comprises a connecting portion 179 which includes a first torsion member 176, a second torsion member 178 and an elongated section 177 therebetween. Torsion members 176 and 178 each operate substantially identically to connecting portion 114 described earlier herein with respect to terminal 112 of FIG. 13.

Figure 21:
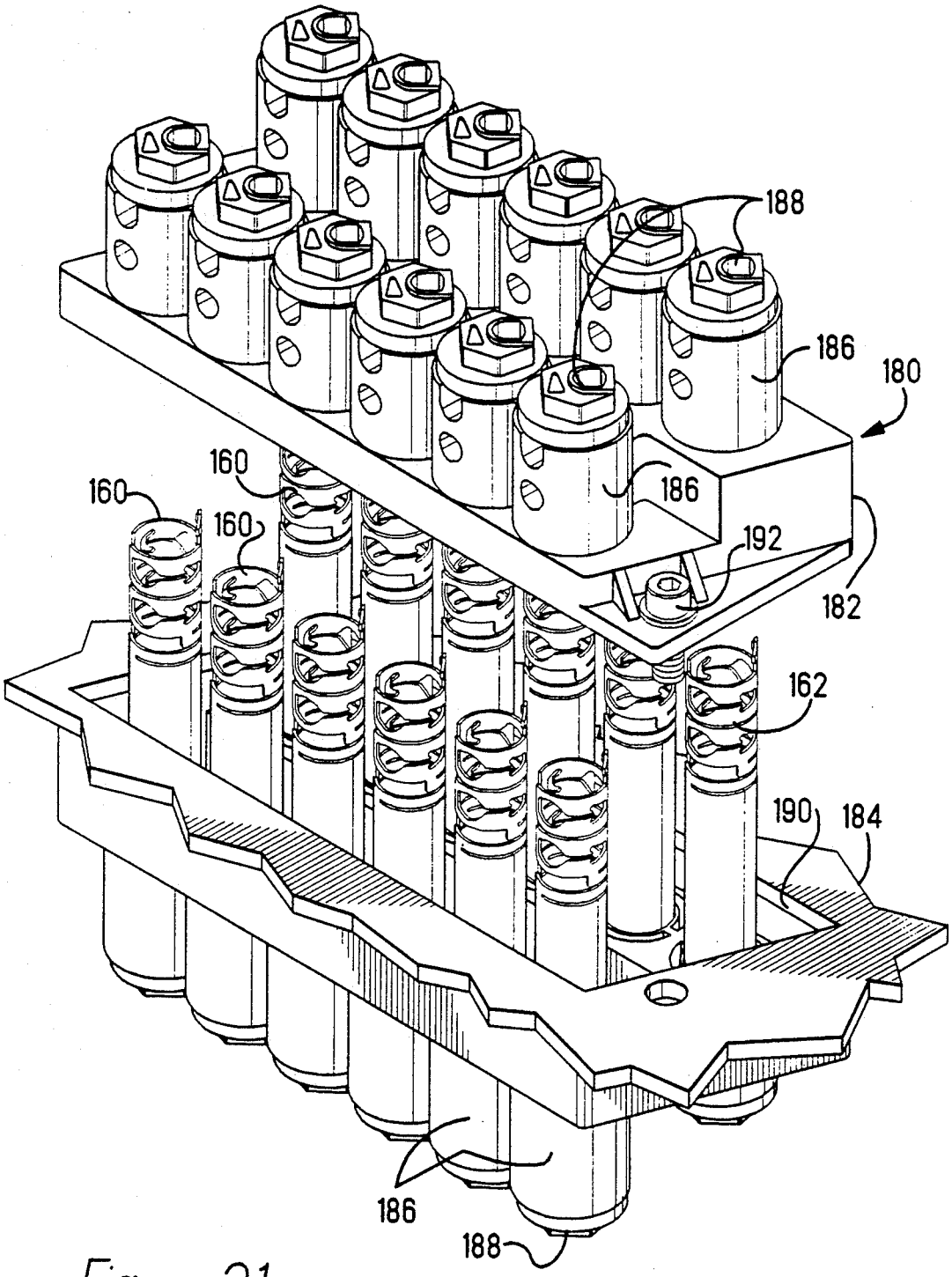
FIG. 21 is a perspective view of an insulating displacing system which is capable of using terminals shown in FIG. 20.

As illustrated in FIG. 21, insulation displacing terminal 160 is suitable for mounting in an insulating housing assembly 180 comprising a top half 182 and a bottom half 184. A plurality of silos or cylindrical insulating walls 186 are integrally formed as part of top and bottom halves 182 and 184. Each silo 186 has a cap 188 associated therewith. Second portion 164 of each terminal 160 is received in a silo 186 on bottom half 184. Top half 182 is then guided over the array of first terminal portions 162, and a potting material for providing an environmental seal is inserted into an inner cavity 190 of each of halves 182 and 184. If halves 182 and 184 are sealed together, as well as mechanically secured together by fasteners 192, no potting material is required.

The operation and installation of first and second portions 162 and 164, silos 186, caps 188, and the insulating housing 180 are essentially identical to the operation of the embodiment shown in FIGS. 12–17, except that the embodiment being described provides for rotational insulation displacement termination on each end of terminal 160. This permits distribution wires (not shown) to be terminated in the second portion 164 in the same manner as insulated wires 12 are terminated in the first portion 162. An advantage which is provided by the embodiment shown in FIGS. 20 and 21 relates to the ease of installation of insulated wires 12 in field applications. In contrast to the embodiments described in FIGS. 1–19, no preparation of the terminal 160 is required prior to use in the field. In other words, in the embodiment shown in FIGS. 20 and 21, there is the ability to terminate both the insulated wire 12 and the distribution wire connected directly to terminal 160 in silos 186, without the need for using an intermediate conductor or stub cable consisting of discrete wires 28. Allowing phone wires, for example, to be terminated directly to terminals 160, provides the installer with an easier method of termination; the installer simply inserts the wires into the openings, rotates the cap, and the wires are terminated, thereby requiring much less time and effort.

While the invention has been described with reference to several specific embodiments, this description is merely illustrative, and it is not to be construed as limiting the scope of the invention. Various other modifications and changes may occur to those skilled in the art without departing from the spirit and scope of the invention as defined by the appended claims.

I claim:

1. An insulation displacement connector assembly for terminating a conductor of an insulated wire for electrical connection to another conductor means, said assembly comprising:

an insulating housing having a terminal receiving cavity defined by and within a cylindrical wall, said cylindrical wall having at least one wall opening for receiving a respective said insulated wire;

a one-piece terminal or slidably mounting in said terminal receiving cavity, said terminal having a first portion, a second portion and a connecting portion integrally joining and electrically connecting said first and second portions, said first portion having at least a first wire receiving opening therethrough aligned with said at least one wall opening for receiving said insulated wire, said first portion also having a first slot which partially extends circumferentially around said terminal and which communicated with each said first wire receiving opening, said second portion adapted to be electrically connected to said other conductor means and said connecting portion being torsional and elastically yielding to permit said first portion to be rotated relative to said second portion;

said terminal receiving cavity and said second portion including cooperating stopping means adapted to prevent rotation of said second portion during rotation of said first portion, and said insulating housing adapted to provide access to said second portion for connecting thereto of said other conductor means; and a cap for slidably mounting onto said housing, said cap being rotatable with respect to said insulating housing and having a wall portion coextending along said first portion of said terminal and having at least one cap opening therein which becomes operatively related to a respective said first wire receiving opening and said wall opening when said cap is mounted onto said housing, said wall portion being capable of engaging and rotating said first portion of said terminal when said cap is rotated;

said conductor of each said insulated wire becoming terminated in a respective said first slot when said insulated wire is placed through a respective said cap opening, said wall opening and said first wire receiving opening, and said cap is rotated to cause said first portion to rotate relative to said second portion.

2. The insulation displacement connector assembly as recited in claim 1 wherein said cylindrical wall comprises a first recess and a second recess, said cap comprising an engaging member which engages said first and second recess to facilitate locking said terminal in an open or closed position, respectively.

3. The insulation displacement connector assembly as recited in claim 1 wherein said connecting portion has a general serpentine shape which permits said first portion to be torqued relative to said second portion, sand said terminal receiving cavity is dimensioned to provide clearance for said serpentine shaped connecting portion when stressed during rotation of said first portion.

4. The insulation displacement connector assembly as recited in claim 1 wherein said terminal is a one-piece construction stamped from a conductive material.

5. The insulation displacement connector assembly as recited in claim 1 wherein said first portion is generally U-shaped having a first wall, a second wall adjacent said first wall and a joining wall joining said first and second walls, said first wall having said first wire receiving opening and said first slot, said second wall having a second wire receiving opening and a second slot which communicates with said second wire receiving opening, said first and second walls also being generally arcuately shaped.

6. The insulation displacement connector assembly as recited in claim 5 wherein said first and second wire receiving openings are directly aligned.

7. The insulation displacement connector assembly as recited in claim 5 wherein said generally U-shaped first portion defines a generally U-shaped gap therewithin, said wall portion of said cap being received in said generally U-shaped gap when said cap is mounted on said terminal, said wall portion engaging said first portion and causing said first portion to rotate in response to the rotation of said cap.

8. The insulating displacement connector assembly as recited in claim 5 wherein said first wall has a third wire receiving opening therethrough and a third slot which communicates with said third wire receiving opening, and said second wall having a fourth wire receiving opening and a fourth slot which communicates with said fourth wire receiving opening.

9. The insulation displacement connector assembly as recited in claim 8 wherein said first wire receiving opening is aligned with said second wire receiving opening and said third wire receiving opening is aligned with said fourth wire receiving opening.

10. The insulating displacement connector assembly as recited in claim 9 wherein said cap has a second cap opening therein which becomes operatively related to said third and fourth wire receiving openings when said cap is slidably mounted on said terminal.

11. The insulation displacement connector assembly as recited in claim 1 wherein said terminal is formed in the shape of a cylinder, said first portion having at least an opposed second wire receiving opening therethrough and a second slot which communicates with said second wire receiving opening, said opposed second wire receiving opening being generally opposed to said first wire receiving opening.

12. The insulation displacement connector assembly as recited in claim 11 wherein said insulating housing comprises a post which extends upwardly from a base of said insulating housing, said post having at least one post opening aligned with a respective said wall opening and which becomes generally aligned with said first wire opening receiving when said terminal is mounted on said post in said insulating-housing, said post opening extending through said post, said post comprising reducer means associated with said post opening for permitting only a wire having less than a predetermined gauge to pass into said opposed second wire receiving opening.

13. The insulation displacement connector assembly as recited in claim 12 wherein said reducer means includes a conical wall formed in said post opening.

14. The insulation displacement connector assembly as recited in claim 12 wherein said first wire receiving opening and said first slot are larger than said opposed second wire receiving opening and said second slot so that said first wire receiving opening and said first slot can terminate an insulated wire having a larger gauge than said second wire receiving opening and said second slot, and said second slot can terminate an insulated wire having a smaller gauge.

15. The insulation displacement connector assembly as recited in claim 14 wherein said insulating housing comprises channel means for receiving an end of a smaller gauge of said insulation wire when said end is inserted through said cap opening, through said first receiving opening, through said post opening, and through said opposed second wire receiving opening, thereby permitting said insulation wire to be terminated in said opposed second wire receiving opening.

16. The insulation displacement connector assembly as recited in claim 1 wherein sad insulating housing comprises a post which extends upwardly from a base of said insulating housing, said post having at least one post opening aligned with a respective said wall opening and which becomes generally aligned with said first wire receiving opening when said terminal is mounted on said post in said insulating housing.

17. The insulation displacement connector assembly as recited in claim 11 wherein said post opening extends completely through said post, and said insulating housing comprises channel means for receiving an end of said insulation wire when said end is inserted through said cap opening, through said first wire receiving opening, through said post opening and through an opposed second wire receiving opening, thereby permitting said insulation wire to be terminated in said opposed second wire receiving opening.

18. The insulation displacement connector assembly as recited in claim 1 wherein said terminal is cylindrical having a first end and a second end, said first end being associated with said first portion and said second end being associated with said second portion, said wall opening being located on said first end;.

said second portion comprising a fifth wire receiving opening, a fifth slot which communicates with said fifth wire receiving opening, a sixth wire receiving opening, and a sixth slot which communicates with said sixth wire receiving opening;

said insulating housing having a second cylindrical wall having a second wall opening which becomes associated with said fifth and sixth wire receiving openings when said terminal is mounted in said insulating housing;

said connecting portion being torsional to permit said first and second portions to be rotated with respect to each other, thereby enabling at least one insulated wire to be terminated in said first portion and also enabling at least one second insulated wire to be terminated in said second portion.

19. The insulation displacement connector assembly as recited in claim 18 wherein said fifth wire receiving opening is generally opposed to said sixth wire receiving opening.

20. The insulation displacement connector assembly as recited in claim 18 further comprising a second cap for slidably mounting on said second portion of said terminal, said second cap being rotatable with respect to said second cylindrical wall of said insulating housing and having a second wall portion having a second cap opening therein which becomes operatively related to said fifth wire receiving opening when said cap is slidably mounted on said second portion of said terminal, and said connection portion permitting said second portion to be rotated relative to said first portion after a second insulated wire has been guided in said second wall opening, one of said fifth and sixth wire receiving openings, and said second cap opening, so that said second insulated wire becomes terminated in aid terminal.

21. The insulation displacement connector assembly as recited in claim 1 wherein said connecting portion includes a torsion strap, and said terminal receiving cavity is dimensioned to provide clearance for said torsion strap when stressed during rotation of said first portion.

22. The insulation displacement connector assembly as recited in claim 21 wherein said torsion strap couples said first portion and said second portion such that said first portion is offset from said second portion when said terminal is stamped from said conductive material so that said first portion can be telescoped towards and away from said second portion.

23. A terminal comprising:

a first portion;

first coupling means located on said first portion for coupling a first wire to said terminal;

a second portion;

second coupling means located on said second portion for coupling a second wire to said terminal; and a torsion coupler connecting said first and second portions, said torsion coupler being torsional to permit said first and second portions to be rotated relative to each other, whereby the rotation of said first portion causes said first coupling means to couple said first wire to said terminal when said first wire is inserted in said first coupling means and the rotation of said second portion causes said second coupling means to couple said second wire to said terminal when said second wire is inserted in said second coupling means.

24. The terminal as recited in claim 23 wherein said first portion is formed to provide a generally U-shaped area, said first portion comprising a first wall, a second wall adjacent to said first wall and a joining wall joining said first and second walls, said first and second walls being arcuately-shaped to facilitate the rotation of said terminal in a cylindrical insulating housing.

25. The terminal as recited in claim 23 wherein said first coupling means comprises:

a first wire receiving opening;

a first slot which communicates with said first wire receiving opening;

a second wire receiving opening;

a second slot which communicates with said second wire receiving opening;

said first wire receiving opening being located opposite said second wire receiving opening.

26. The terminal as recited in claim 25, wherein said first and second portions are cylindrical;

said second coupling means comprising:

a fifth wire receiving opening located on said second portion;

a fifth slot located on said second portion which communicates with said fifth wire receiving opening;

a sixth wire receiving opening located on said second portion;

a sixth slot located on said second portion which communicates with said sixth wire receiving opening;

said sixth wire receiving opening being located opposite said fifth receiving opening;

said torsion coupler permitting said second portion to be rotated relative to said first portion to cause said second wire to be coupled to said terminal.

27. The terminal as recited in claim 24 wherein said first portion includes a first wall and a second wall which is adjacent to said first wall, said first wire receiving opening being located on said first wall and said second wire receiving opening being located on said second wall opposed from and aligned with said first wire receiving opening, and said first wire receiving opening being larger than said second wire receiving opening.

28. The terminal as recited in claim 27 wherein said terminal further comprises:

a third wire receiving opening located on said first wall;

a third slot located on said first wall which communicates with said second wire receiving opening;

a fourth wire receiving opening located on said second wall;

a fourth slot located on said second wall which communicates with said fourth wire receiving opening;

said third wire receiving opening being located opposite said fourth wire receiving opening.

29. An insulation displacing connector assembly for the electrical termination of an insulated wire for electrical connection with another conductor means, the insulation displacing connector assembly comprising:

an insulation base member comprising a floor with a post upstanding from said floor, said post having a post opening therethrough for receiving an end of said insulated wire;

a cylindrical terminal for detachably mounting on said post, said cylindrical terminal having a first portion, a second portion, and a connecting portion conductively connecting said first and second portions;

said first portion having a first wire receiving opening therethrough, said first portion also having a first slot which partially extends circumferentially around said terminal and which communicates with said first wire receiving opening, said first wire receiving opening becoming aligned with said post opening when said cylindrical terminal is detachably mounted on said post;

said second portion being fixedly held against rotation by holding means of said base member and including connection means for electrical connection with said other conductive means; and rotating means for rotating said first portion;

said connecting portion being torsional such that, when said terminal is mounted on said post and said wire is placed through said first wire receiving opening and in said post opening, said rotating means can cause said first portion to rotate relative to said second portion, thereby causing said conductor of said insulated wire to become terminated in said first slot.

30. The insulation displacing connector assembly as recited in claim 29 wherein said terminal is a one-piece construction stamped from a conductive material.

31. The insulation displacing connector assembly as recited in claim 29 wherein said rotating means comprises a cap for slidably mounting on said cylindrical terminal, said cap having a wall portion having a cap opening therein, said cap opening becoming operatively related to said first wire receiving opening when said cap is slidably mounted on said terminal, said wall portion engaging said first portion and causing said first portion to rotate when said cap is rotated.

32. The insulation displacing connector assembly as recited in claim 31 wherein said first portion comprises a second wire receiving opening therethrough and a second slot which communicates with said second wire receiving opening, said second wire receiving opening being smaller than said first wire receiving opening and being located opposite said first wire receiving opening; said post opening permitting said first wire to be guided through said post and into said second wire receiving opening, said cap having a second cap opening therein which becomes operatively related to said second wire receiving opening when said cap is slidably mounted on said terminal.

33. The insulation displacing connector assembly as recited in claim 32 wherein said connecting portion has a general serpentine shape.

34. The insulation displacing connector assembly as recited in claim 32 wherein said connecting portion includes a torsion strap.

35. The insulation displacing connector assembly as recited in claim 34 wherein said torsion strap couples said first portion and said second portion such that said first portion is offset from said second portion so that said first portion can be telescoped towards and away from said second portion when said first portion is rotated in a clockwise and counterclockwise direction, respectively.

* * * * *